United States Patent [19]

Williams et al.

[11] 4,199,764

[45] Apr. 22, 1980

[54] DUAL BAND COMBINER FOR HORN ANTENNA

[76] Inventors: Robert A. Frosch, Administrator of the National Aeronautics and Space Administration, with respect to an invention of William F. Williams, La Canada; Seymour B. Cohn, Encino, both of Calif.

[21] Appl. No.: 8,207

[22] Filed: Jan. 31, 1979

[51] Int. Cl.[2] ..... H01Q 13/00

[52] U.S. Cl. ..... 343/786; 343/895

[58] Field of Search ..... 343/729, 755, 776, 786, 343/854, 895

[56] References Cited

U.S. PATENT DOCUMENTS

| | | | |
|---|---|---|---|
| 2,398,096 | 4/1946 | Katzin | 343/786 |
| 3,325,817 | 6/1967 | Ajioka et al. | 343/786 |
| 3,389,394 | 6/1968 | Lewis | 343/786 |
| 3,423,756 | 1/1969 | Foldes | 343/786 |
| 3,568,204 | 3/1971 | Blaisdell | 343/786 |
| 3,631,502 | 12/1971 | Peters, Jr. et al. | 343/786 |
| 3,732,571 | 5/1973 | Neale | 343/786 |
| 4,077,039 | 2/1978 | Ren et al. | 343/786 |

*Primary Examiner*—David K. Moore

*Attorney, Agent, or Firm*—Monte F. Mott; John R. Manning; Paul F. McCaul

[57] ABSTRACT

A corrugated horn antenna adapted to be coupled to a waveguide at the apex thereof for X-band excitation is further adapted to be connected to waveguides through a circumferential slot for S-band excitation at four distinct phases $S_1$ through $S_4$ selected for the desired S-band polarization. The circumferential slot is positioned along the axial length of the horn for good impedance matching and is provided with an X-band choke in the form of two concentric choke slots. For further improvement in impedance matching, the second (outer) choke slot is divided by plugs into four segments that coincide with waveguide ports for the four distinct phases of the S-band.

9 Claims, 5 Drawing Figures

DUAL BAND COMBINER FOR HORN ANTENNA

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S. 2457).

BACKGROUND OF THE INVENTION

This invention relates to a dual band horn antenna and more particularly to a dual-band horn antenna operating in the linearly polarized mode and/or in the circularly polarized mode.

Horn antennas are widely used as elements to feed paraboloid reflectors in Cassegrain and other reflector antenna. In some cases, in order to operate such a reflector antenna in dual band, such as in X-band and S-band, a dichroic subreflector transparent to the S-band and reflective to the X-band is used. The X-band fed through the horn antenna is reflected by the hyperbolic dichroic subreflector. The S-band is fed by another element at the paraboloid focus through the dichroic subreflector. This feed permits full performance for telementry within S-band, while at the same time allowing for operation within X-band.

In another case, e.g., the reflex feed used within the Deep Space Network Stations of JPL/NASA, both frequencies are operated as Cassegrain by using a flat dichroic plate in the region of an S-band and X-band horn. The S-band horn energy is reflected by an elliptical subreflector onto the dichroic plate and thence to the main hyperboloid. The X-band horn energy transmits through the dichroic plate and to the hyperboloid. The final phase center for the S-band system is the same as the X-band as determined by the shape (elliptic) and location of the S-band reflectors.

The corrugated horns used in such a reflex feed yields very good performance, but the use of the dichroic subreflector and the large asymmetric feed structure results in degradation (about 0.5 dB) of X-band performance. This is because of some small loss in the dichroic subreflector and some back scatter at X-band resulting in an increase (2° or 3° K.) in the X-band antenna noise temperature. What is required is a feeding technique that will more nearly optimize X-band performance, with only slight degradation of S-band performance. To accomplish that, it is evident that the dichroic subreflector must be removed, but then the two bands must be fed from the same or coaxial apertures. Some obvious approaches to accomplish this are: an X-band horn within (coaxial with) the S-band horn, an X-band end fire element (disc-on-rod or helix) within the S-band horn, and an array of four or more S-band horns surrounding the X-band radiator, much like a monopulse system. All of these approaches would result in a considerable S-band performance compromise (~2 dB), and the use of anything but a good horn for X-band might well have as much loss as the dichroic subreflector. The only obvious approach available is to actually use the same horn with both hands and develop a technique that will result in acceptable illumination functions in both of these widely separated frequencies.

SUMMARY OF THE INVENTION

In accordance with the present invention, the same horn operable at two widely spaced frequency bands with nearly identical radiation patterns is achieved by using a corrugated horn and a combiner to excite the horn in its two frequency bands, and operating in a beamwidth saturation mode. The combiner, which must have a low loss at the X-band (excited through the apex of the horn) of less than 0.02 dB for useful application, is comprised of a circumferential slot for S-band injection and designed with a choke for the X-band rejection. The circumferential slot position in the horn is chosen to obtain good S-band impedance matching. Excitation of the slot is through four equally spaced waveguide ports. Two opposite ports are fed with 180° phase difference to yield a horizontal polarization, and the other two ports are fed with 180° phase difference to yield a vertical polarization. Feeding the ports around the circumferential slot with a 90° phase difference from port to port clockwise or counter-clockwise yields a circular polarization of one sense or the other.

The novel features of the invention are set forth with particularity in the appended claims. The invention will be best understood from the following description when read in conjunction with the accompanying drawings.

DESCRIPTION OF PREFERRED EMBODIMENTS

Figure 1:
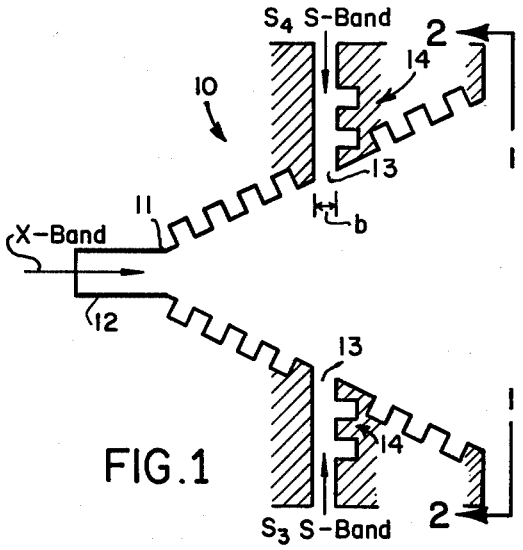
FIG. 1 illustrates schematically a cross section of a novel combiner or diplexer for a dual-band horn antenna.

Referring now to FIG. 1, there is shown schematically a cross section of a feed horn capable of operation at two widely spaced frequency bands, X-band and S-band, and having nearly identical radiation patterns in the two bands made possible by a new and improved dual band combiner used to excite this horn in its two frequency bands. The X-band (8.4 to 8.55 GHz) excitation of the horn antenna is coupled through the apex 11 by a waveguide 12. The horn is excited in the S-band (2.1 to 2.3 GHz) through a circumferential slot 13 without increasing the noise temperature at X-band, and virtually without additional loss at X-band over and above the loss at X-band that would occur if the horn were used alone at X-band without using a combiner. Circumferential choke slots 14 are designed to reject the X-band from the combiner. In that manner, a corrugated horn operable at two widely spaced frequency bands with nearly identical radiation patterns is achieved. The horn is excited in its two frequency bands and operated in a beam width saturation mode, which is with the horn of a length increased to the point where additional length does not make the pattern narrower nor does it make the horn develop higher gain. A depth of corrugation is selected to satisfy the requirements of corrugated feed horn operation within both frequency bands.

The combiner has a low loss at X-band of less than 0.02 dB. That is important because beyond this value, the additional noise in the system from this loss would render the horn useless for some applications, such as deep space telemetry reception and navigation. The technique which makes this possible is to feed the S-band signal into the horn through the circumferential feed slot 13 that has designed into it the choke 14 that acts like an X-band stop filter. This is illustrated schematically in FIG. 1.

Figure 2:
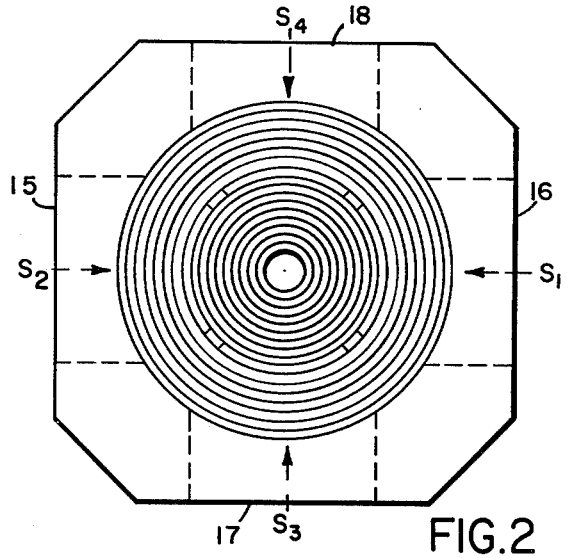
FIG. 2 illustrates schematically an end view of a horn antenna according to the invention shown schematically in FIG. 1.

The circumferential feed slot is excited through four waveguide ports 15–18 shown in FIG. 2 designed into the horn antenna structure in order to be able to feed signals $S_1$ and $S_2$ from opposite sides with 180° phase difference to yield horizontal polarization, and to feed signals $S_3$ and $S_4$ through opposite sides with 180° phase difference to yield vertical polarization. Feeding the ports around the circumferential slot with a 90° phase difference from port to port clockwise or counterclockwise yields circular polarization of one sense or the other.

The circumferential feed slot 13 is located within the corrugated horn proper at a position emperically selected to obtain good impedance matching, and the dimension b of the slot is chosen at less than one-half wavelength at the highest X-band frequency, such as 0.350 inches. This limits any attempts at X-band propagation within the line to $TM_{mo}$ radial modes, where m is the number of $\lambda/2$ variations around the circumference, and there are no $\lambda/2$ variations in the b direction. The $TE_{20}^r$ (m=2) radial mode is excited by X-band $HE_{11}$ wave (or by $TM_{11}$ wave if present). Therefore, the radial line band stop filter is designed to stop X-band in the $TE_{20}$ radial line mode, and also to present $X_{in}=0$ looking into the annular opening at X-band. This will result in negligible effect on the X-band $HE_{11}$ wave i.e., negligible leakage reflection, or mode conversion.

Figure 3:
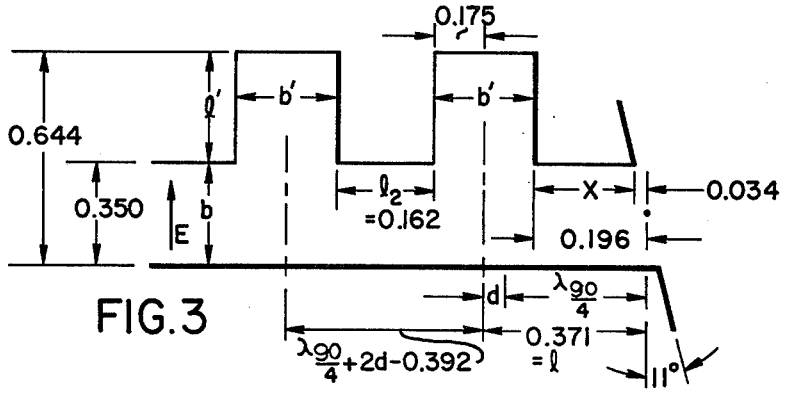
FIG. 3 illustrates the design of the choke slots for X-band in an S-band circumferential slot.
Figure 4A:
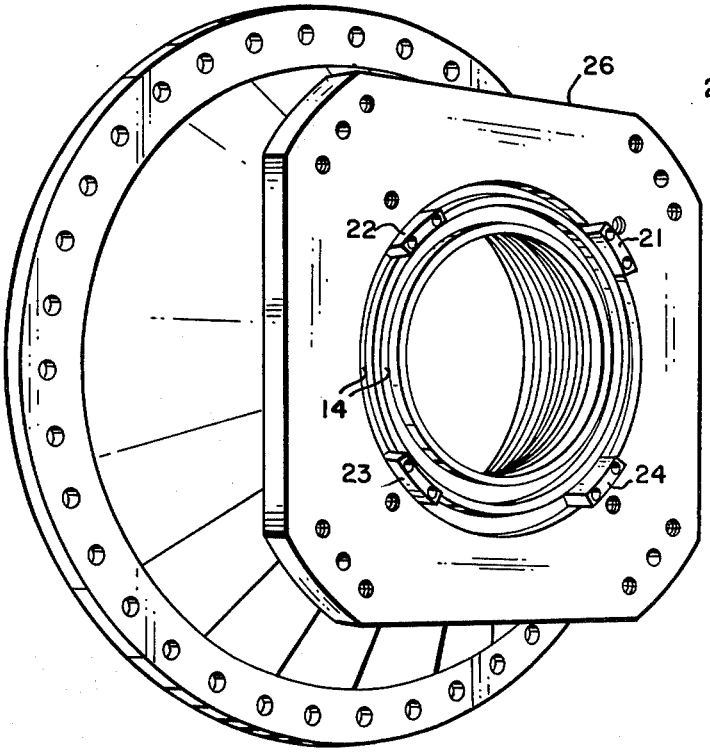
FIGS. 4*a* and 4*b* illustrate the two parts of a horn made in accordance with the teachings of FIGS. 1, 2 and 3 and separated at the S-band circumferential slot.
Figure 4B:
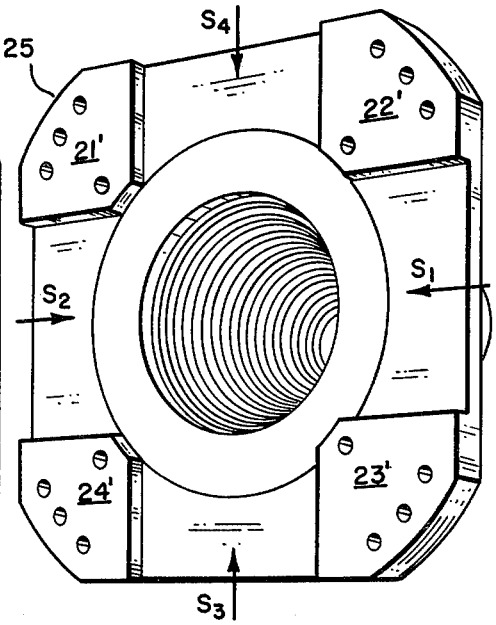

The design of the X-band choke slots is illustrated in FIG. 3. Dimension b of FIG. 1 is chosen at 0.35", about ¼ a guide wavelength in X-band. Using the Radiation Laboratory Waveguide Handbook, Vol. 10, pp. 337–350, the remaining dimensions for the choke are obtained and are indicated in FIG. 3. A second choke slot was added according to the same dimension. Beyond these X-band chokes, the radial line continues for a short distance, and is then terminated in four places with step junction transformers (not shown). These transformers have four steps and terminate in standard WR430 waveguide. The construction of this combiner is shown in FIGS. 4*a* and 4*b*.

The structure has been separated into two sections for viewing. The section in FIG. 4*b* is the input end, showing the taper to a small X-band input end. The section in FIG. 4*a* is the output end with the pair of X-band choke slots 14. The addition of four plugs 21 to 24 in the second choke slot improves matching. These plugs are situated next to respective corner sections "21 to 24" on a flange 25 which, when fastened to a flange 26, forms the waveguide ports 15 to 18 indicated in FIG. 2. These plugs thus limit the second choke slot to just the segments into which the waveguide slots open, while the first choke slot is a complete circumferential choke slot in the circumferential feed slot 13. Noise measurements with this horn-combiner combination indicate essentially no addition of noise due to the combiner. When compared to an X-band corrugated horn without the combiner, no additional noise could be noted with a resolution of tenths of a Kelvin.

In summary an X-S combiner is provided in a corrugated horn antenna with different polarizations, such as right circular polarization at S-band and right and left circular polarization at X-band with losses at S-band less than 0.2 dB and losses at X-band of less than 0.02 dB relative to the horn antenna without the combiner. The technique for this combiner is to feed the S-band into the horn through a circumferential slot that is designed to stop the X-band with a choke, or band stop filter. This is best illustrated schematically in FIG. 1. The radial line injection region is shown within the horn proper at a position along the horn proper selected to obtain good impedance matching. The dimension b is chosen at less than one-half wavelength at the highest X-band frequency. This limits any attempts at X-band propagation within the line to $TM_{mo}^r$ radial modes, as noted hereinbefore.

To test operation of the combiner made in accordance with the foregoing description, opposite pairs of S-band inputs, $S_1$ and $S_2$, must be measured and developed together since they are used together to create a linear polarization (a $HE_{11}$ circular waveguide hybrid mode) and there is significant cross-coupling between them. The other inputs, $S_3$ and $S_4$, are decoupled from the first pair and used to create the orthogonal linear mode. The two pairs, taken together, will generate circular polarization. These opposite pairs must be excited in phase opposition, i.e., 180° out of phase with each other, in order to properly generate the $TE_{11}$ mode instead of the next higher mode, the $TM_{01}$.

The S-band test generator is therefore fed into an E-H plane tee (180° hybrid). This will immediately develop the 180° phase difference when using the E-plane input arm. The arm lengths to the combiner inputs must then be equal in order to maintain this 180° phase differential. A slotted line is used to perform the measurement on an input arm and therefore a straight waveguide section of the same phase length is used in the other input arm to maintain this exact phase relationship. In this manner the mutual coupling between opposite arms is "tuned out" as though part of a mismatch reflection.

It was determined by these measurements that an inductive iris was needed at the waveguide inputs to the combiner. This S-band waveguide is only 0.89 cm (0.35 in.) high and the standard 10.92 cm (4.3 in.) wide. This matched input in narrow waveguide was then transformed up to the standard WR430 size using a 4-step, 3-section, waveguide transformer.

Below are tabulated the final voltage standing wave ratios (VSWR) for this combiner at S-band.

| Frequency (GHz) | VSWR |
|---|---|
| 2.100 | 9.50 |
| 2.150 | 4.50 |
| 2.200 | 2.68 |
| 2.225 | 2.01 |
| 2.250 | 1.50 |
| 2.275 | 1.23 |
| 2.300 | 1.04 |
| 2.325 | 1.19 |
| 2.350 | 1.54 |
| 2.375 | 2.11 |
| 2.400 | 2.94 |
| 2.450 | 6.20 |
| 2.500 | 16.50 |

From this it is noted that the bandwidth is only 100 MHz for a VSWR of less than 1.5. This is suitable for receiving operations only; another combiner could be used for S-band transmission.

The most important characteristic of the combiner is that it have extremely low loss at X-band, i.e., does not contribute any further noise to the system. This noise was measured by using the combiner in a full scale horn. This combination was used with an X-Band maser amplifier setup for measuring total noise temperature by comparing it with an identical system using an X-band horn without the combiner. The horn without the combiner has a certain measurable noise level when looking to the open sky (receiving from space.) The horn and combiner were then substituted to determine a different noise level as caused by this different configuration. A long sequence of these substitution measurements were made. The result of all measurements indicated that essentially no difference existed between the two systems.

Although a particular embodiment has been illustrated and described, it is recognized that modifications and variations may readily occur to those skilled in the art. Consequently, it is intended that the following claims be interpreted to include such modifications and variations.

What we claim is:

1. In a corrugated horn antenna adapted to be excited through the apex thereof at one frequency band, a combiner for excitation of the horn at a lower frequency band comprised of a circumferential feed slot in a plane perpendicular to the horn axis, the position of said plane along the length of the horn axis being selected for optimum impedance matching, said feed slot being of a width, b, less than half a guide wavelength of the highest of the one frequency band, and a circumferential choke in said feed slot.

2. The combination of claim 1 including waveguide ports into said circumferential slot for coupling excitation of said lower frequency from said circumferential slot.

3. The combination of claim 2 wherein said waveguide ports consist of a first pair of waveguide ports opposite each other for excitation 180° out of phase and a second pair of waveguide ports opposite each other and oriented 90° from said first pair of waveguide ports for excitation 180° out of phase, whereby, excitation of said first and second pairs of waveguide ports may be selected for a desired polarization.

4. The combination of claim 3 wherein said circumferential choke is comprised of two annular slots of a width about one fourth a guide wavelength in the one frequency band.

5. The combination of claim 4 wherein the outer one of said two annular slots is divided by plugs into four sections, each section coinciding with a waveguide port, to improve impedance matching.

6. A dual band antenna operable at two widely spaced frequency bands with nearly identical radiation patterns comprising a corrugated horn and a combiner to excite said horn in its two frequency bands, and operating in a beamwidth saturation mode, said combiner having a low loss at the band excited through the apex of the horn of less than 0.02 dB and being comprised of a circumferential feed slot with circumferential choke slots for the other band being diplexed, said circumferential feed slot position being chosen to obtain good impedance matching.

7. A dual band antenna as defined in claim 6 wherein said circumferential slot is coupled to four equally spaced waveguide ports for excitation with energy of the other band being diplexed at distinct phases.

8. A dual band antenna as defined in claim 7 wherein two of said waveguide ports opposite each other and on a horizontal axis are fed with 180° phase difference to yield a horizontal polarization, and two of said waveguide ports opposite each other and on a vertical axis are fed with 180° phase difference to yield a vertical polarization.

9. A dual band antenna as defined in claim 7 wherein said four equally spaced waveguide ports are excited with 90° phase difference from port to port in a selected direction for circular polarization in the selected direction.

* * * * *